US006414255B1

(12) United States Patent
Thamm et al.

(10) Patent No.: US 6,414,255 B1
(45) Date of Patent: Jul. 2, 2002

(54) SWITCH

(75) Inventors: Christian Alfons Thamm, Aukrug; Claus-Peter Schulze, Neumunster; Gerd Jodehl, Wasbek, all of (DE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/402,769

(22) PCT Filed: Apr. 9, 1998

(86) PCT No.: PCT/EP98/02107

§ 371 (c)(1),
(2), (4) Date: Apr. 14, 2000

(87) PCT Pub. No.: WO98/47160

PCT Pub. Date: Oct. 22, 1998

(30) Foreign Application Priority Data

Apr. 11, 1997 (DE) ..... 197 15 115

(51) Int. Cl.[7] ..... H01H 9/30

(52) U.S. Cl. ..... 218/22; 218/30; 218/32; 335/16; 200/275

(58) Field of Search ..... 200/560, 275, 200/17 R, 284; 218/22, 30, 31, 32, 33; 335/16, 192, 193

(56) References Cited

U.S. PATENT DOCUMENTS

| | | | | |
|---|---|---|---|---|
| 2,597,368 A | | 5/1952 | Page | 200/166 |
| 3,930,211 A | | 12/1975 | Belttary | 335/6 |
| 4,683,358 A | * | 7/1987 | Dittmann | 200/243 |
| 5,324,901 A | * | 6/1994 | Hendel et al. | 200/238 |
| 5,369,235 A | * | 11/1994 | Hendel | 200/275 |
| 5,828,276 A | * | 10/1998 | Kurono et al. | 335/35 |
| 6,121,560 A | * | 9/2000 | Turkmen | 200/271 |

FOREIGN PATENT DOCUMENTS

| | | | |
|---|---|---|---|
| DE | 698 456 C | 11/1940 | |
| DE | 81 09 089 U | 8/1981 | H01H/1/16 |
| FR | 2 461 348 A | 1/1981 | H01H/73/04 |

* cited by examiner

*Primary Examiner*—Michael Friedhofer
(74) *Attorney, Agent, or Firm*—Cantor Colburn LLP

(57) ABSTRACT

A switch device for switching an electrical connection between two connection parts is disclosed. Conventional switch devices comprise a contact lever having a switch contact, the flow of current taking place by way of the contact lever when the switch device is closed. To achieve a rapid switching process, a low mass inertia of the contact lever is required. However, this generally leads to a lower current capacity. By arranging the lever-side switch contact on a separate electrical connection device, it becomes possible to separate the function of current conduction from the function of contact guidance. Since the contact lever therefore no longer performs any current-conducting function, it may be optimized in mechanical respects exclusively.

16 Claims, 2 Drawing Sheets

SWITCH

FIELD OF THE INVENTION

The invention relates generally to switching devices, and, more particularly, to a switch device including a lever-side switch contact.

Referring to prior art FIG. 2, a switch device, such as for example a fast direct-current switch, is diagrammatically shown. The switch device comprises a first and a second rigid connection part 5, 4 for connecting a circuit to be switched and a movable contact lever 1 mounted rotatably about an axis 6. On the contact lever 1, there is a contact plate 2 for providing switch contact on the lever side. By actuating the contact lever 1, a contact can be made between the contact plate 2 and a switch contact of the first connection part 5, whereby the circuit is closed across the two connection parts 4 and 5 (cf. switch condition in FIG. 2, in dot-dash lines).

According to the prior art, the contact plate 2 is fixed to the movable contact lever 1, which is electrically connected by way of a flex band 3 for example to the second connection part 4. Instead of the flex band 3, current pins, friction contacts or the like are possible as connecting devices between the contact lever and the second connection part 4. Thus the circuit to be switched in the present example is closed as in FIG. 2 across the two connection parts 4 and 5, the contact lever 1 and the flex band 3.

Points of contact transition in switch devices lead to increased electrical losses and interfere with heat flow. Particularly in the field of opening switch contacts in safety circuit devices, optimal conformation is required. For current limitation, a fast opening of the contact after occurrence of a short circuit is required. The contact lever should be of such conformation as to meet the following mechanical and electrical requirements.

In mechanical regard, the contact lever should exhibit a minimal mass inertia, in order to make possible a fast switching operation. A required high current capacity results in a maximal contact lever cross-section and a minimal specific resistance of the contact lever material as electrical requirements.

From the aforementioned requirements, however, it is apparent that an improvement in mechanical properties generally leads to an impairment of the electrical properties, and vice versa.

SUMMARY OF THE INVENTION

In an exemplary embodiment of the invention lever-side switch contact is arranged on a connecting device to provide a switch, the function of conducting current and heat is separated from the function of contact guidance. Thus the contact lever performs purely mechanical guidance functions, so that the requirements imposed on it as to current capacity are eliminated. Owing to the separation of the current conductive function from the contact guiding function, the contact lever may be produced in light-weight construction with low mass inertia, from electrically non-conductive material for example.

The conformation of the switch device of the invention permits the use of a relatively long, flexible connecting device such as for example a flex band, whereby a conformation having a positive influence on service life can be realized.

Further, the reduction of contact transition points and the direct connection of the lever-side switch contact to the connection device achieve a high thermal and electrical conductivity.

DESCRIPTION OF THE PREFERRED EMBODIMENT

Figure 1:
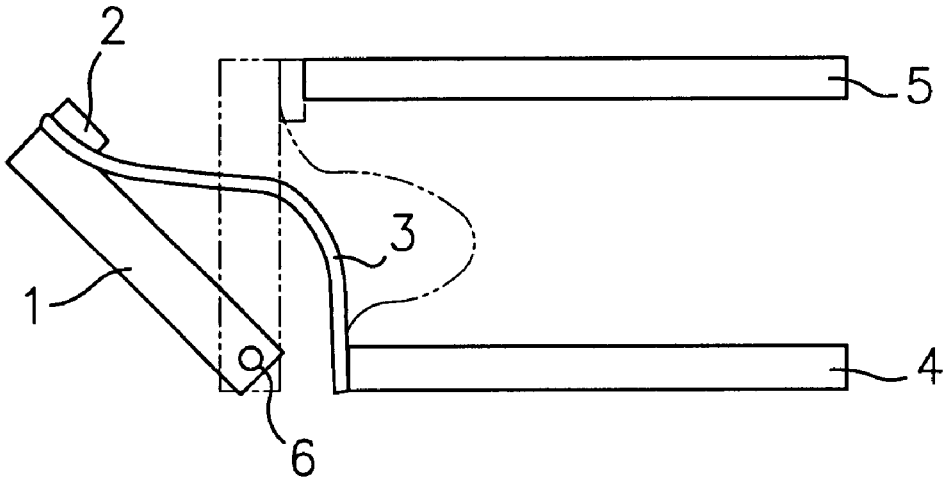
FIG. 1 shows a representation in principle of the switch device according to the invention.
Figure 2:
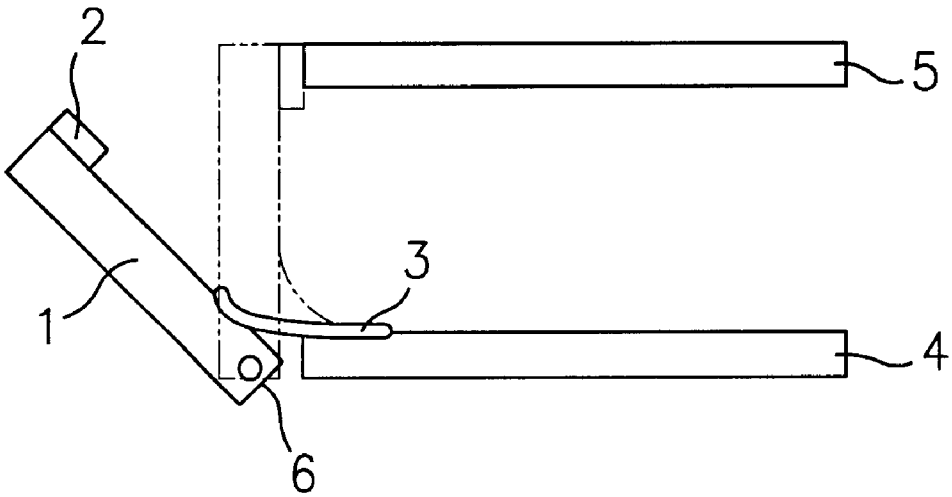
FIG. 2 (PRIOR ART)
FIG. 2 shows a representation in principle of a switch device according to the prior art.

In an exemplary embodiment of the present invention, the contact plate 2 is arranged directly on the flex band 3 serving as movable connecting device. In to the switch condition shown in dot-dash lines, the path of current with switch device closed passes solely by way of the two connection parts 4 and 5 and the flex band 3. The function of the contact lever 1 is thus limited to contact guidance, and so it may be made of non-conductive material. Besides, the current transition point between the flex band 3 and the contact lever is eliminated.

The flex band is preferably of such shape conformation that as low-wear, low-closure a switch operation as possible is obtained. This may for example be done by means of a suitable curvature and attachment to the second connection part 4.

Figure 3:
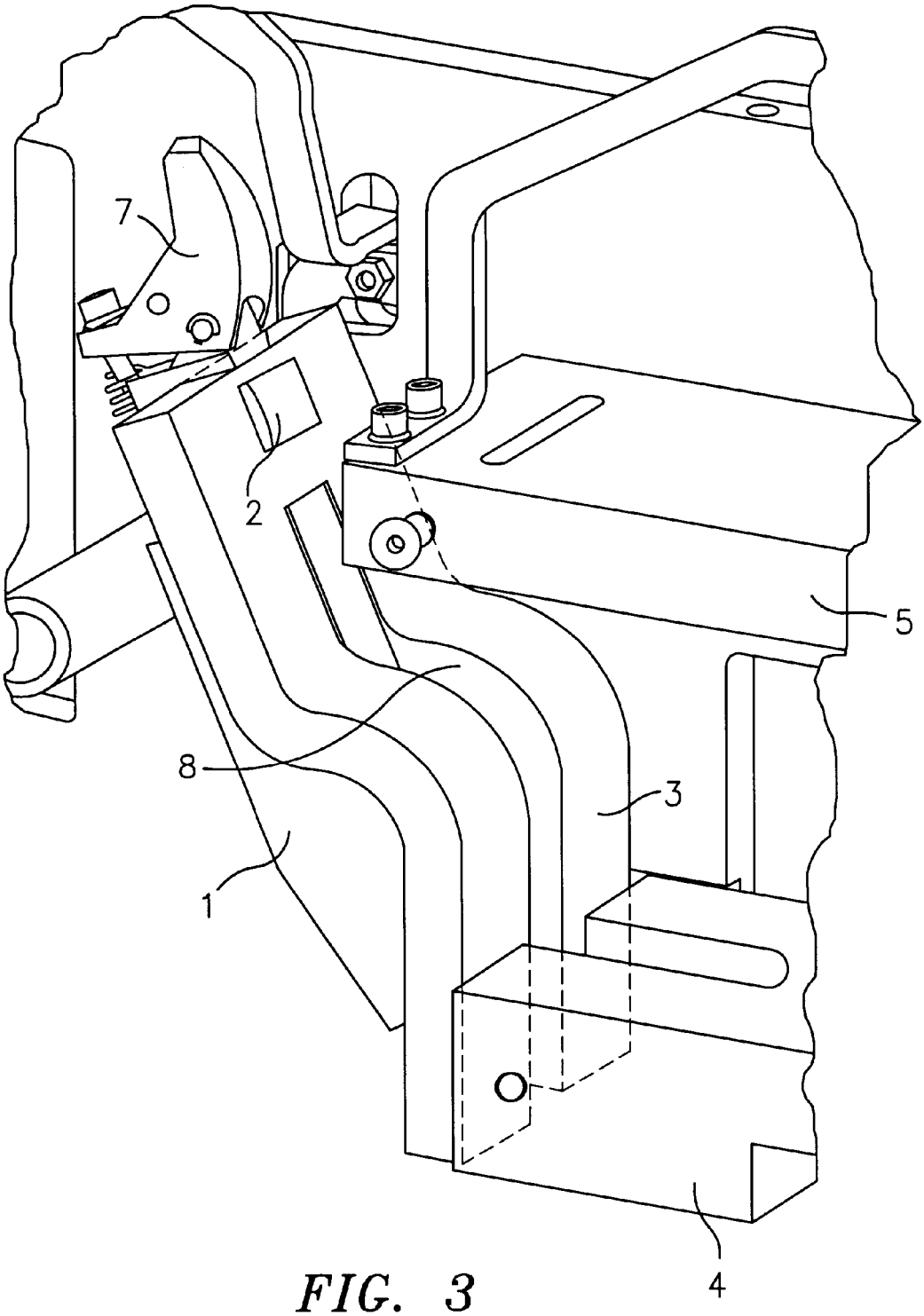
FIG. 3 shows a perspective view of an example of an embodiment of the invention.

FIG. 3 shows a schematic view of an example of embodiment of tie switch device according to the invention as a fast direct-current switch. A flexible copper band 3 is so connected at its bottom end to the second connection part 4 that it is oriented towards the first connection part 5. The copper band 3 exhibits a precurvature, so that mechanical stresses arising in switch operation are reduced. Besides, the copper band comprises a slit 8 into which the contact lever 1 is partly fitted. At the top of the copper band 3, an electrically conductive contact plate 2 is soldered directly to the copper band 3 or a suitable connection support. The upper portion of the copper band 3 is fitted into a recess of the contact lever 1, and preferably pressure-welded to achieve a solid electrical connection. At the top of the contact lever 1, a pre-contact 7 is arranged, protecting the main contact from burning in operational switching processes and thus lengthening the service life of the main contact.

In general, a switch device for switching an electrical connection between two connection parts is disclosed.

Conventional switch devices comprise a contact lever having a switch contact, the flow of current being passed over the contact lever when the switch device is closed. To achieve a rapid switch operation, a low mass inertia of the contact lever is required. But this generally leads to less current capacity, By arranging the lever-side switch contact on a separate electrical connection device, a separation of the function of current conduction from the function of contact guidance is possible. Since the contact lever therefore no longer performs any current-conducting function, it can be optimized in mechanical respects exclusively.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A switch device for switching an electrical connection between a first and a second connection part, the switch device comprising:

a movable contact lever for switching a lever-side switch contact and a switch contact of the first connection part;

an electrical connection device electrically connected to the second connection part, the electrical connecting device comprising an electrically conductive flexible band, the band having a slit aperture through which a portion of the movable contact lever is fitted; and wherein the lever-side switch contact is arranged on the electrical connection device.

2. The switch device claim 1, wherein the contact lever is comprised of non-conductive material.

3. The switch device of claim 1 wherein the lever-side switch contact comprises a contact plate arranged on the band.

4. The switch device of claim 1, wherein the band is a copper band.

5. The switch device of claim 4 wherein the lever-side switch contact is soldered to the band.

6. The switch device of claim 5 wherein the band is pressure-welded at the lever-side switch contact.

7. The switch device of claim 1 wherein the band has a predetermined curvature which limits mechanical stress on the band.

8. The switch device of claim 1, wherein an end of the copper band which is pressure-welded at the lever-side switch contact is fitted into a recess of the contact lever.

9. The switch device of claim 1 further comprising a pre-contact on the contact lever for contacting the switch contact on the first connection part prior to the lever-side switch contact making contact with the switch contact on the first connection part.

10. A switch device for switching an electrical connection between a first and a second connection part, the first and second connection parts separated by a distance, the switch device comprising:

a non-conductive movable contact lever for switching a lever-side switch contact and a switch contact of the first connection part, the contact lever substantially spanning the distance between the first and second connection parts;

an electrical connection device electrically connected to the second connection part; and wherein the lever-side switch contact is arranged on the electrical connection device.

11. The switch device of claim 10 wherein the electrical connection device comprises a flex band.

12. The switch device of claim 11 wherein the lever-side switch contact is soldered to the flex band.

13. The switch device of claim 11, wherein the moveable contact lever is partly fitted into a slit aperture of the flex band.

14. The switch device of claim 11 wherein the flex band has a predetermined curvature.

15. The switch device of claim 10 further comprising a pre-contact on the contact lever for contacting the switch contact on the first connection part prior to the lever-side switch contact making contact with the switch contact on the first connection part.

16. The switch device of claim 10 wherein the contact lever has a pivot point adjacent the second connection part.

* * * * *